US010344653B2

(12) United States Patent
Gong et al.

(10) Patent No.: US 10,344,653 B2
(45) Date of Patent: Jul. 9, 2019

(54) FLUID DELIVERY DEVICE

(71) Applicant: TENNECO (SUZHOU) EMISSION SYSTEM CO., LTD., Kunshan Suzhou, Jiangsu (CN)

(72) Inventors: Chao Gong, Kunshan Suzhou (CN); Ping Wang, Kunshan Suzhou (CN); Gaofeng Fan, Kunshan Suzhou (CN); Qiang Sun, Kunshan Suzhou (CN); Zhenqiu Yang, Kunshan Suzhou (CN); Biao Du, Kunshan Suzhou (CN); Suheng Tian, Kunshan Suzhou (CN)

(73) Assignee: TENNECO (SUZHOU) EMISSION SYSTEM CO., LTD., Kunshan, Suzhou (CN)

( * ) Notice: Subject to any disclaimer, the term of this patent is extended or adjusted under 35 U.S.C. 154(b) by 139 days.

(21) Appl. No.: 15/526,708

(22) PCT Filed: Nov. 12, 2015

(86) PCT No.: PCT/CN2015/094451
§ 371 (c)(1),
(2) Date: May 12, 2017

(87) PCT Pub. No.: WO2016/074631
PCT Pub. Date: May 19, 2016

(65) Prior Publication Data

US 2017/0306820 A1 Oct. 26, 2017

(30) Foreign Application Priority Data

Nov. 14, 2014 (CN) ..... 2014 1 0643987

(51) Int. Cl.
*F01N 13/00* (2010.01)
*F01N 3/20* (2006.01)
(Continued)

(52) U.S. Cl.
CPC ..... *F01N 3/208* (2013.01); *F01N 3/08* (2013.01); *F01N 11/00* (2013.01); *F02M 37/00* (2013.01);
(Continued)

(58) Field of Classification Search
CPC ..... F01N 2610/02; F01N 2610/14; F01N 2610/1433; F01N 2610/144; F01N 2610/148; F02M 37/045
See application file for complete search history.

(56) References Cited

U.S. PATENT DOCUMENTS

2011/0146249 A1 6/2011 Palluat de Besset et al.
2013/0071268 A1 3/2013 Ryoo et al.

FOREIGN PATENT DOCUMENTS

CN 1738970 A 2/2006
CN 103670612 A 3/2014
(Continued)

OTHER PUBLICATIONS

Machine translation of CN104074740A, accessed Nov. 26, 2018.*

*Primary Examiner* — Jonathan R Matthias
(74) *Attorney, Agent, or Firm* — Harness, Dickey & Pierce, P.L.C.

(57) ABSTRACT

A fluid delivery device, comprising an integrated cabinet, a pump installed in the integrated cabinet, an inlet pipeline connected to the pump, and an outlet pipeline connected to the pump; the pump comprises a motor located at the bottom portion of the integrated cabinet, a pump head located at the top portion of the integrated cabinet, and a magnetic coupling portion located between the motor and the pump head; the pump head, the magnetic coupling portion and the motor are arranged in a sequence from top to bottom; and the pump head is provided with a U-shaped flow channel and a gear mechanism therein located at the bottommost portion of the flow channel. The fluid delivery device eliminates bubbles in
(Continued)

the solution accumulated in the pump, thus ensuring a working efficiency of fluid delivery of the pump, and ensuring precise control of a delivery amount.

9 Claims, 14 Drawing Sheets

(51) Int. Cl.

| | |
|---|---|
| ***F01N 3/08*** | (2006.01) |
| ***F01N 11/00*** | (2006.01) |
| ***F02M 37/00*** | (2006.01) |
| ***F02M 37/04*** | (2006.01) |
| ***F04B 15/04*** | (2006.01) |

(52) U.S. Cl.

CPC ..... *F02M 37/0076* (2013.01); *F02M 37/045* (2013.01); *F04B 15/04* (2013.01); *F01N 2610/02* (2013.01); *F01N 2610/14* (2013.01); *F01N 2610/144* (2013.01); *F01N 2610/148* (2013.01); *F01N 2610/1433* (2013.01)

(56) References Cited

FOREIGN PATENT DOCUMENTS

| | | | |
|---|---|---|---|
| CN | 104074740 | A | 10/2014 |
| CN | 104405479 | A | 3/2015 |
| CN | 204267134 | U | 4/2015 |
| CN | 204267137 | U | 4/2015 |
| DE | 102006007554 | A1 | 8/2007 |
| DE | 102009014436 | A1 | 10/2010 |
| WO | WO-2013123865 | A1 | 8/2013 |

* cited by examiner

FLUID DELIVERY DEVICE

CROSS REFERENCE TO RELATED APPLICATIONS

This application is a U.S. National Phase Application under 35 U.S.C. 371 of International Application No. PCT/CN2015/094451 filed on Nov. 12, 2015 and published in Chinese as WO 2016/074631 A1 on May 19, 2016. This application is based on and claims the benefit of priority from Chinese Patent Application No. 201410643987.9 filed Nov. 14, 2014. The entire disclosures of all of the above applications are incorporated herein by reference.

TECHNICAL FIELD

The present invention relates to a fluid conveying device, in particular to a fluid conveying device arranged in an engine exhaust gas treatment system.

BACKGROUND ART

An engine exhaust gas treatment system in the prior art usually comprises a urea tank, a urea pump for extracting a urea solution from said urea tank and a nozzle connected to said urea pump. Said nozzle is used for injecting atomized urea into an exhaust pipe of an engine to purify exhaust gas.

However, in practical applications, bubbles are often produced in a system pipeline, and the working efficiency and metering accuracy of urea solution pumping of said urea pump would be reduced due to the bubbles.

SUMMARY OF THE INVENTION

An object of the present invention is to provide a fluid conveying device with a higher liquid pumping efficiency and a higher metering accuracy.

In order to achieve such an object, the technical solution of the present invention is implemented as follows: a fluid conveying device is provided, which is used for conveying a urea solution in an engine exhaust gas treatment system, said fluid conveying device comprising an integrated cabinet, a pump mounted in said integrated cabinet, an inlet pipeline connected to said pump and an outlet pipeline connected to said pump, wherein said pump comprises a motor positioned at the bottom, a pump head positioned at the top and a magnetic coupling part positioned between said motor and said pump head, said pump head, said magnetic coupling part and said motor are arranged from top to bottom, and a U-shaped flow passage and a gear mechanism positioned at the bottommost of said flow passage are arranged in said pump head.

As a further improved technical solution of the present invention, said inlet pipeline and said outlet pipeline are connected to two ends of the flow passage respectively, and said inlet pipeline, said outlet pipeline and said pump head are mutually connected to form an inverted U shape.

As a further improved technical solution of the present invention, said integrated cabinet is provided with a bottom wall, and said inlet pipeline is provided with a before-pumping monitoring module close to said bottom wall, an inlet pipe connected to said before-pumping monitoring module and vertically extending and an inlet connecting pipe connected to said inlet pipe and said pump head; and said outlet pipeline is provided with an after-pumping monitoring module close to the bottom wall, an outlet pipe connected to said after-pumping monitoring module and vertically extending and an outlet connecting pipe connected to said outlet pipe and said pump head.

As a further improved technical solution of the present invention, a negative pressure sensor and a urea temperature sensor are mounted on said before-pumping monitoring module, and a pressure sensor is mounted on said after-pumping monitoring module.

As a further improved technical solution of the present invention, each of said before-pumping monitoring module and said after-pumping monitoring module penetrates through said bottom wall, a urea suction interface is formed in said before-pumping monitoring module, a urea output interface is formed in said after-pumping monitoring module, and said urea suction interface and said urea output interface are both positioned in the bottom of said integrated cabinet.

As a further improved technical solution of the present invention, said integrated cabinet comprises a front wall, a rear wall, a top wall, a bottom wall, a first sidewall and a second sidewall, wherein a man-machine interaction interface, an emergency stop switch, a main power switch, a monitoring indicator and a door lock are arranged on the front wall; and said man-machine interaction interface, said emergency stop switch and said main power switch are arranged in the middle of said front wall, and are sequentially arranged in a vertical direction from top to bottom; a pump driving module mounted on the inner side of the top wall is further arranged in said integrated cabinet; and a number of harness connectors are exposed from the outer side of said first sidewall, and a controller is mounted on the inner side of said first sidewall.

As a further improved technical solution of the present invention, said pump driving module is closely attached to said top wall.

As a further improved technical solution of the present invention, said magnetic coupling part comprises a driving magnetic driver and a driven magnetic driver, a pump head input shaft is arranged on said driven magnetic driver, and said pump head input shaft is connected to said gear mechanism.

As a further improved technical solution of the present invention, said integrated cabinet is further provided with an adjustment supporting mechanism arranged on said rear wall, and said pump is arranged on the adjustment supporting mechanism in a wall hanging manner.

As a further improved technical solution of the present invention, said front wall is openable after said door lock is unlocked, a fixing mechanism connected to said integrated cabinet is arranged on the inner side of said first sidewall, said fixing mechanism is able to be unlocked after said front wall is opened, said first sidewall is openable after said fixing mechanism is unlocked, and an opening direction of said front wall is the same as that of said first sidewall.

Compared with the prior art, said pump head, said magnetic coupling part and said motor are arranged from top to bottom in the fluid conveying device of the present invention, and the U-shaped flow passage and the gear mechanism positioned at the bottommost of said flow passage are arranged in said pump head, so that the bubbles accumulated in the urea solution in said pump can be eliminated, so as to ensure the liquid pumping efficiency and delivery metering control accuracy of said pump.

PARTICULAR EMBODIMENTS

Figure 1:
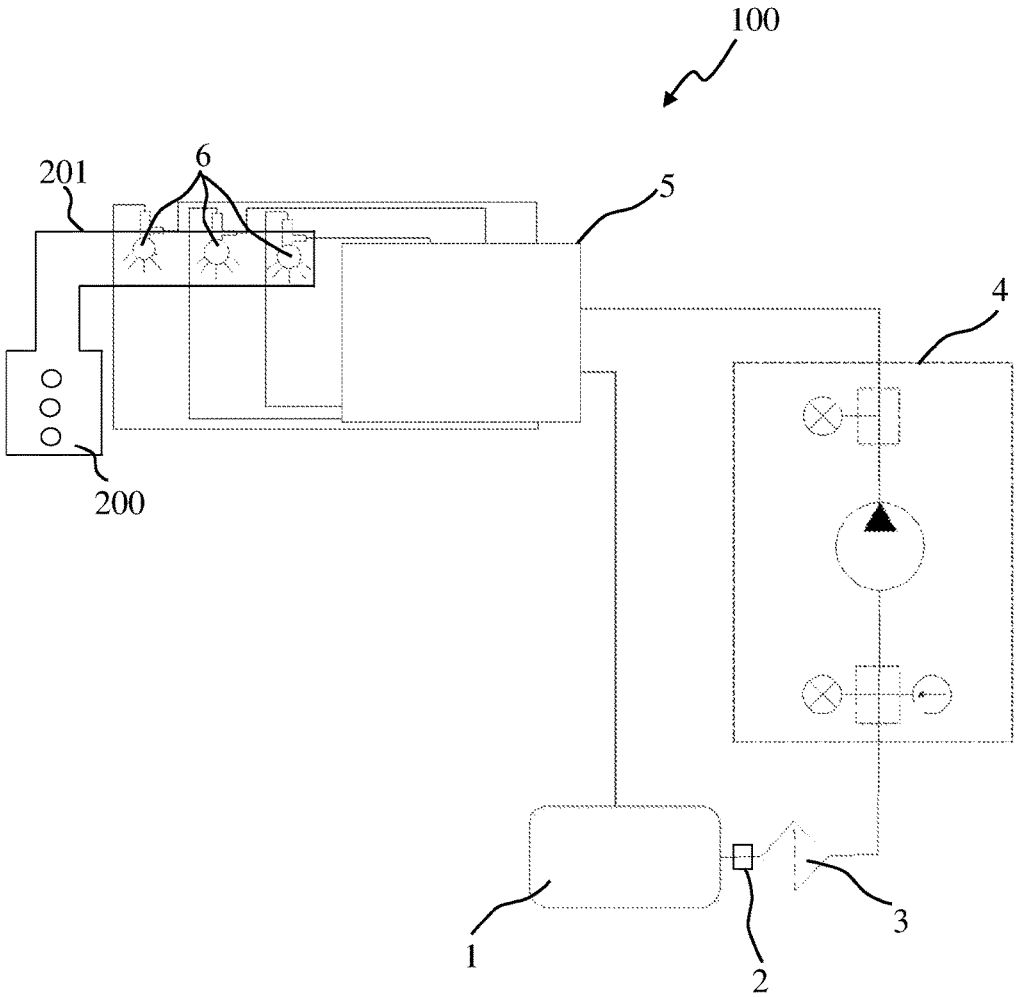
FIG. 1 is a schematic diagram of an engine exhaust gas treatment system as claimed in the present invention.

With reference to FIG. 1, the present invention discloses an engine exhaust gas treatment system 100, which is applied to the exhaust gas treatment of an engine 200. The engine exhaust gas treatment system 100 comprises a urea tank 1, a sensor integrated device 2 connected to said urea tank 1, a filter 3 connected to the downstream of said sensor integrated device 2, a fluid conveying device 4 for conveying a urea solution, a common rail 5 connected to said fluid conveying device 4 and nozzles 6 connected to said common rail 5. In an embodiment of the present invention shown in the drawings, the engine 200 is a high-power engine of which the power generally exceeds 500 kilowatts. Correspondingly, in general, there are multiple nozzles 6. The nozzles 6 are used for injecting the urea solution into an engine exhaust pipe 201. The atomized urea solution is decomposed into ammonia in the engine exhaust pipe 201, and the ammonia can be reacted with nitrogen oxides in exhaust gas, thereby reducing the emission of the nitrogen oxides. Considering that the principle of such an exhaust gas treatment technology is well known by a person skilled in the art, repeated description will not be given herein.

Figure 2:
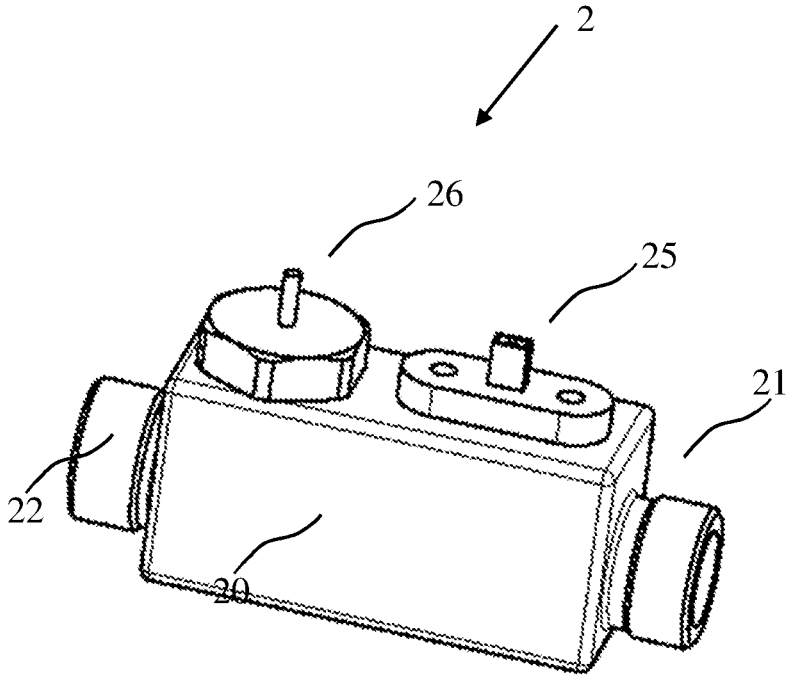
FIG. 2 is a perspective view of a sensor integrated device as claimed in the present invention.
Figure 3:
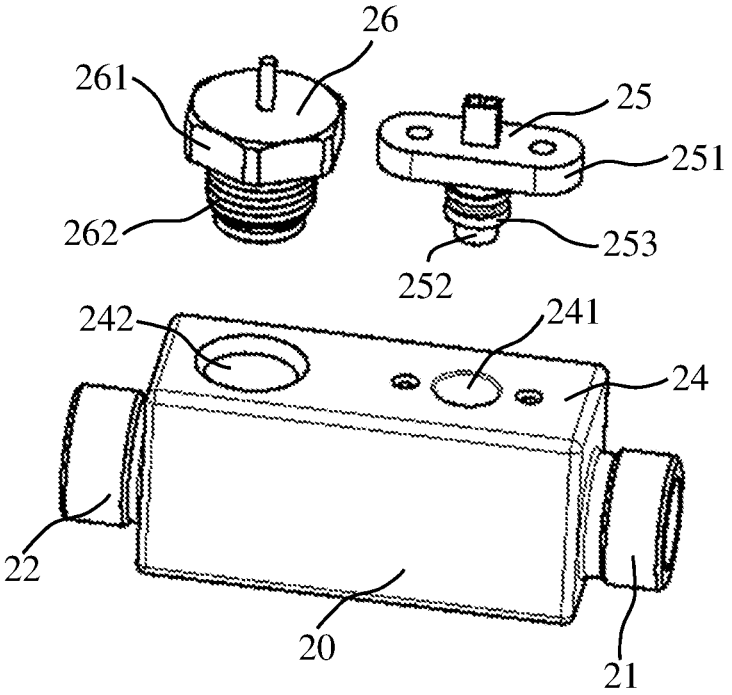
FIG. 3 is a partial exploded perspective view of FIG. 2.
Figure 4:
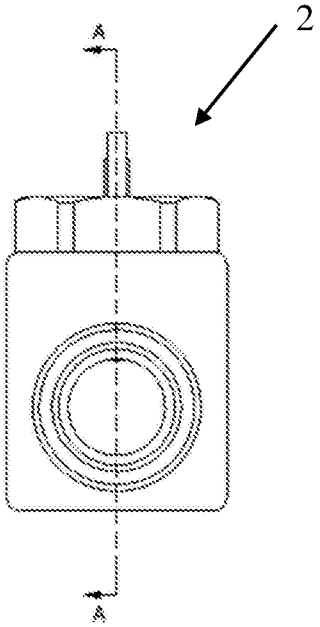
FIG. 4 is a side view of the side of the sensor integrated device having a second connector as claimed in the present invention.
Figure 5:
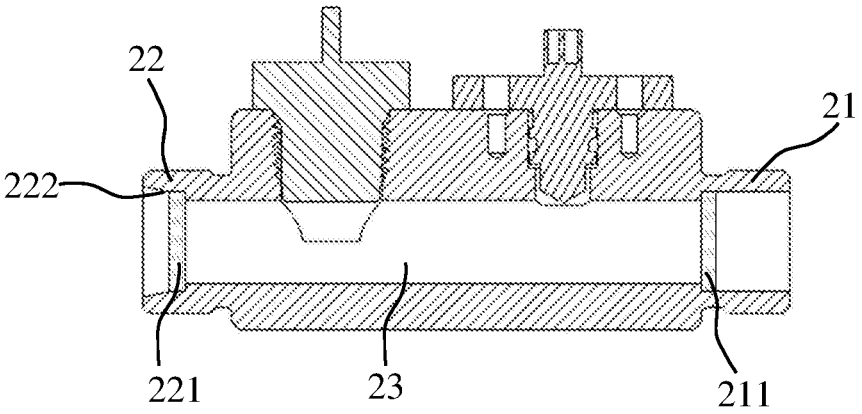
FIG. 5 is a sectional view of the sensor integrated device of the present invention along the A-A line in FIG. 4.

With reference to FIG. 2, the sensor integrated device 2 comprises a main body part 20 positioned in the middle, a first connector 21 positioned on one side of the main body part 20 and a second connector 22 positioned on the other side of the main body part 20. In an embodiment of the present invention shown in the drawings, the main body part 20 is substantially rectangular, and each of the first connector 21 and the second connector 22 is provided with an external thread. The first connector 21 is used for connection with the urea tank 1. With reference to FIGS. 3 and 5, the main body part 20 comprises a cavity 23, a surface 24 surrounding the cavity 23, and a urea temperature sensor 25 and a urea pressure sensor 26 which are mounted on the surface 24. A first mounting hole 241 in communication with the cavity 23 and a second mounting hole 242 close to the first mounting hole 241 are formed in the surface 24. The first mounting hole 241 is used for mounting the urea temperature sensor 25, and the second mounting hole 242 is used for mounting the urea pressure sensor 26. In an embodiment of the present invention shown in the drawings, the first mounting hole 241 and the second mounting hole 242 are close to each other, and are positioned on the same side of the main body part 20. In this way, the urea temperature sensor 25 and the urea pressure sensor 26 can be conveniently mounted from the side on one hand; and on the other hand, since the urea temperature sensor 25 is close to the urea pressure sensor 26, the data of the two can be combined to facilitate the accurate comprehensive judgment of a controller (not shown in the features).

The urea temperature sensor 25 comprises a first mounting part 251, a first extending part 252 extending from the first mounting part 251, and a first sealing ring 253 sheathed onto the first extending part 252. After the urea temperature sensor 25 is assembled in the first mounting hole 241, a good sealing effect can be achieved by the first sealing ring 253. After assembling, the first mounting part 251 is pressed against the surface 24. The tail end of the first extending part 252 is exposed in the cavity 23. When the urea solution flows through the cavity 23, the urea temperature sensor 25 can detect its temperature and conduct such a temperature signal to said controller.

The urea pressure sensor 26 comprises a second mounting part 261 and a second extending part 262 extending from the second mounting part 261. An internal thread is arranged on the inner side of the second mounting part 242, an external thread is arranged on the outer side of the second extending part 262, and said internal thread can be matched with said external thread to realize sealing. After assembling, the second mounting part 261 is pressed against the surface 24. The tail end of the second extending part 262 is exposed in the cavity 23. When the urea solution flows through the cavity 23, the urea pressure sensor 26 can detect its pressure and conduct such a pressure signal to said controller.

Figure 6:
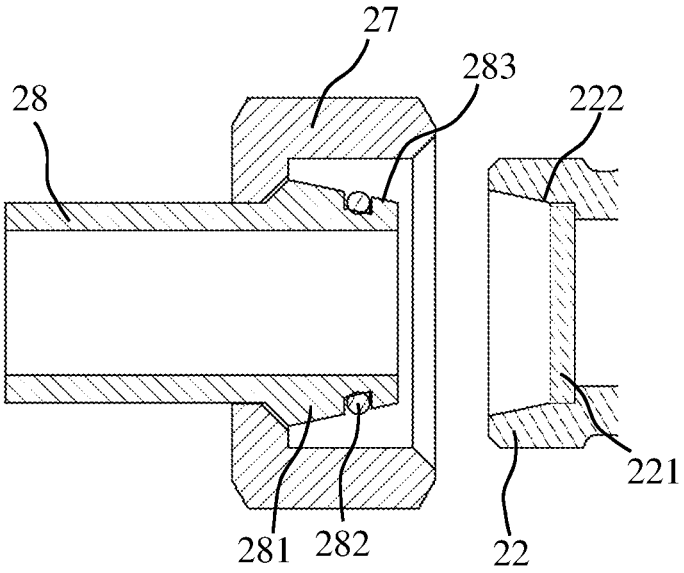
FIG. 6 is a schematic view in which the second connector of the sensor integrated device of the present invention is not connected to a pipeline which is sheathed inside a pipe sleeve.
Figure 7:
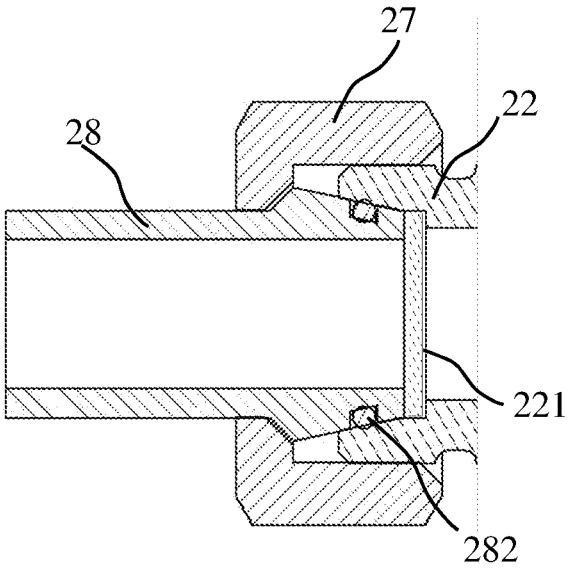
FIG. 7 is a schematic view in which the pipeline in FIG. 6 is inserted into the second connector.

With reference to FIG. 5, filter screens 211 and 221 are mounted in the first connector 21 and the second connector 22 respectively, so as to filter the urea solution. A first tapered sealing surface 222 positioned on the outer side of the filter screen 221 is arranged in the second connector 22. With reference to FIG. 6, during use, the second connector 22 is connected to a pipeline 28 via a pipe sleeve 27. Specifically, the pipe sleeve 27 is provided with an opening (unnumbered) through which the pipeline 28 penetrates and an internal thread positioned on the inner side. The pipeline 28 comprises a head part 281 and a sealing ring 282 sheathed onto the head part 281. The head part 281 is provided with a second tapered sealing surface 283 corresponding to the first tapered sealing surface 222. With reference to FIG. 7, during assembling, the head part 281 of the pipeline 28 is inserted into the second connector 22, such that the first tapered sealing surface 222 is attached to the second tapered sealing surface 283 to achieve a good sealing performance. In addition, the sealing ring 282 is positioned between the first tapered sealing surface 222 and the second tapered sealing surface 283 for further sealing. The internal thread of the pipe sleeve 27 is matched with the external thread of the second connector 22, in this way, the pipeline 28 is connected to the second connector 22 in the pipe sleeve 27.

At present, there are many types of urea tanks on the market, some of the urea tanks have liquid level sensors arranged therein, but some do not have; therefore, a technical problem to be solved in the industry is to design an exhaust gas treatment system applicable to various types of urea tanks. The urea temperature sensor 25 and the urea pressure sensor 26 are mounted on the sensor integrated device 2 as claimed in the present invention. In this way, even though the urea tank 1 itself is not provided with a liquid level sensor, a liquid level in the urea tank 1 can still be deduced by converting the pressure signal of the urea pressure sensor 26 into a corresponding electrical signal. That is to say, the sensor integrated device 2 of the present invention can be applied to all types of urea tanks 1, which brings great convenience to a customer for application. With the sensor integrated device 2, accurate urea monitoring, pressure stabilization and multi-stage purification are intelligently integrated.

Figure 8:
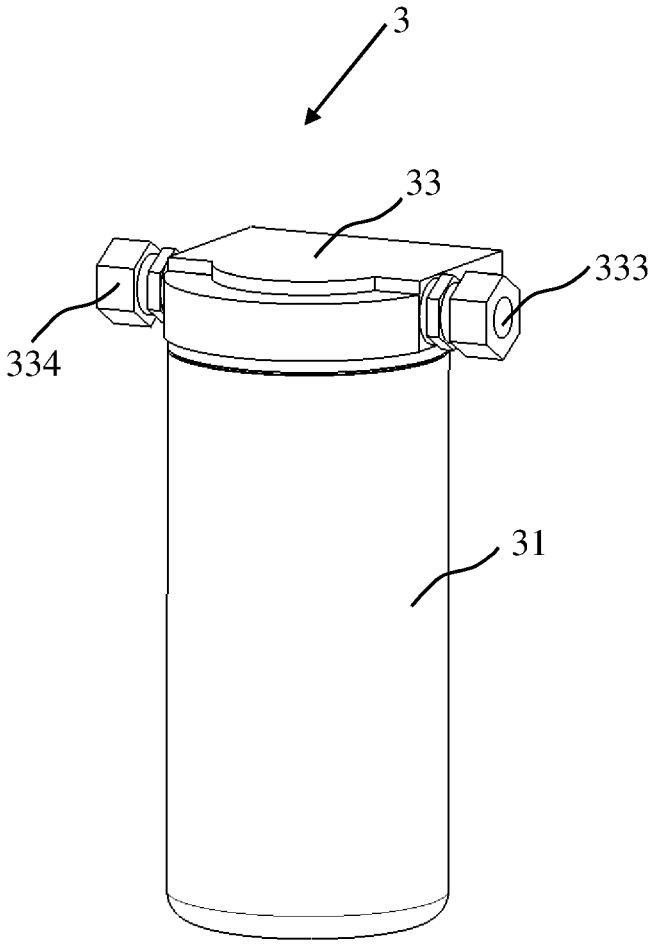
FIG. 8 is a perspective view of a filter as claimed in the present invention.
Figure 9:
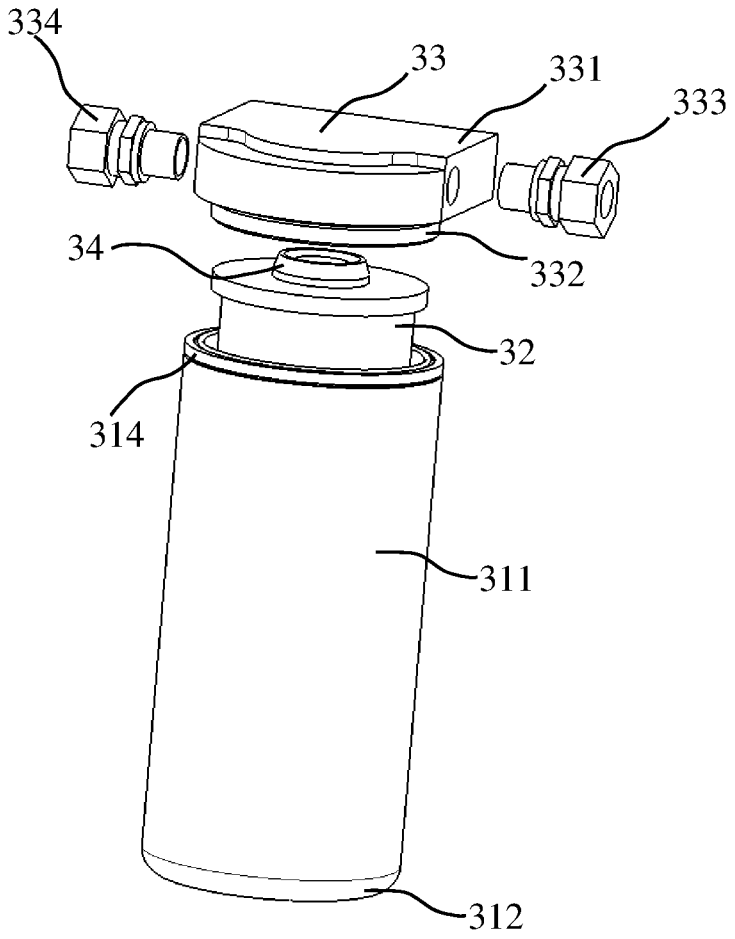
FIG. 9 is a partial exploded perspective view of FIG. 8.
Figure 10:
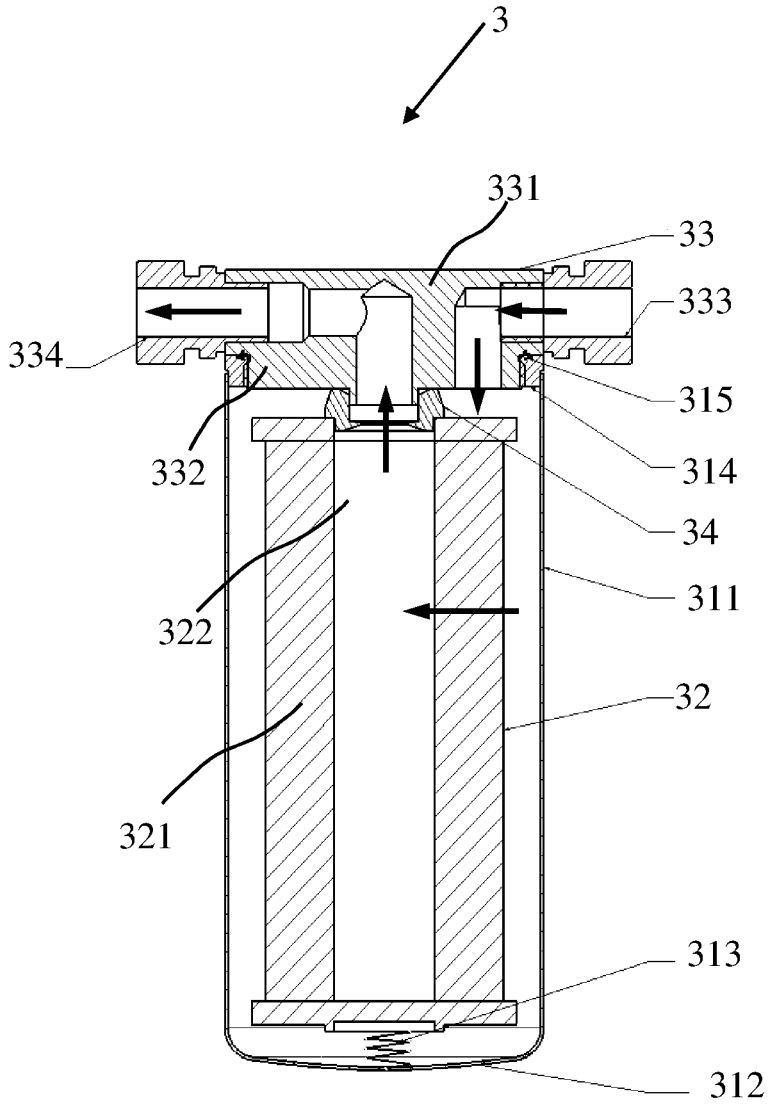
FIG. 10 is a sectional view of the filter in FIG. 8.
Figure 11:
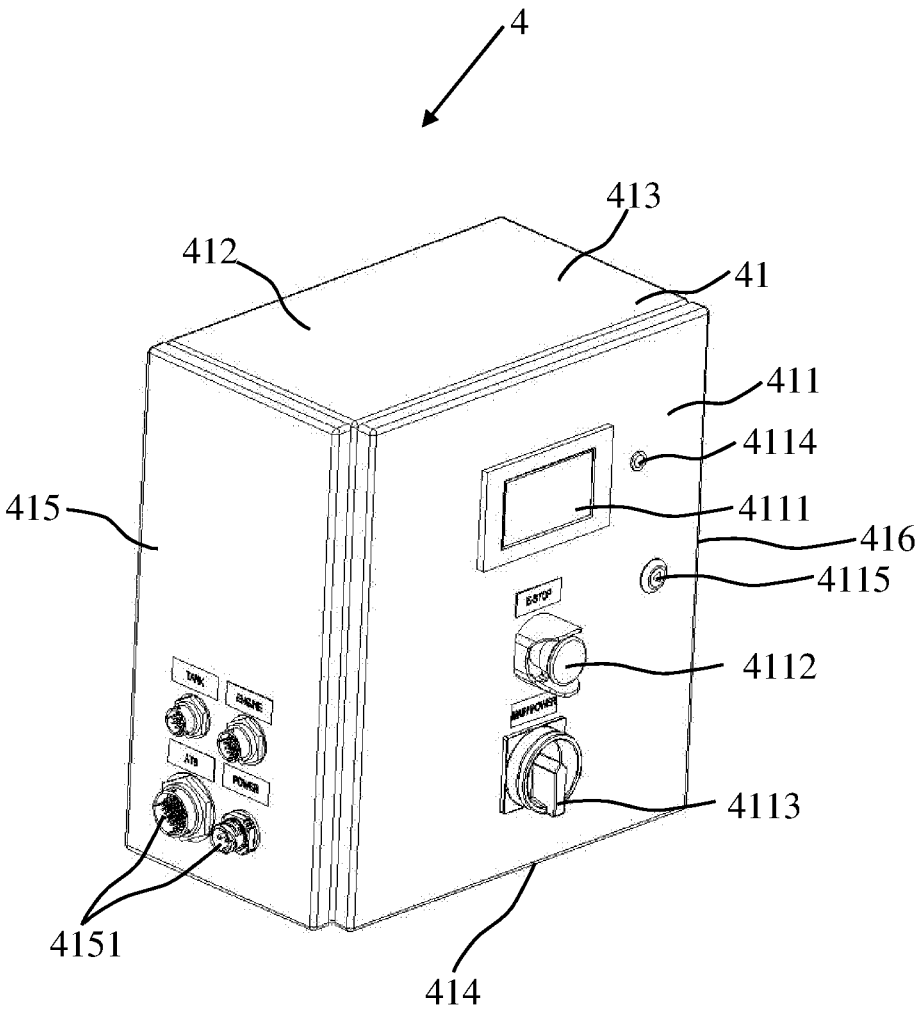
FIG. 11 is a perspective view of a fluid conveying device as claimed in the present invention.
Figure 12:
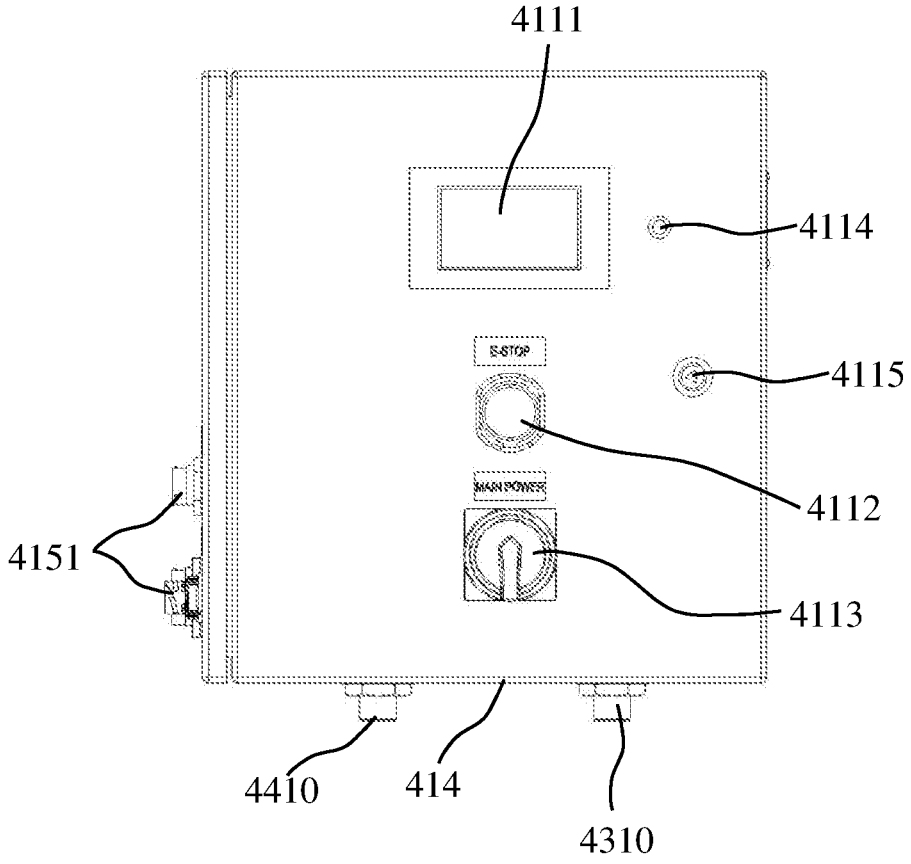
FIG. 12 is a front view of the fluid conveying device as claimed in the present invention.

With reference to FIGS. 8-10, the filter 3 comprises a shell 31, a filter element 32 mounted in the shell 31 and a head part 33 matched with the shell 31. The filter element 32 is in a substantially hollow tubular shape, and comprises a filtering layer 321 positioned on the outer periphery and an inner space 322 surrounded by the filtering layer 321. The head part 33 comprises an upper end part 331, a lower end part 332 positioned at the bottom of the upper end part 331, an inlet connector 333 connected to one side of the upper end part 331 and an outlet connector 334 connected to the other side of the upper end part 331. The inlet connector 333 and the outlet connector 334 are arranged separately from the upper end part 331, and then are assembled together, so that replacement is convenient. The upper end part 331 and the lower end part 332 are both machined parts, and form an integrated structure. In this way, molding costs can be reduced. In addition, inlet and outlet holes of the machined parts can be opened larger so as to meet the requirement of large flow rate.

With reference to FIG. 10, the filter 3 further comprises a rubber pad 34 positioned between the filter element 32 and the lower end part 332. The lower end part 332 at least partially extends into the rubber pad 34, and the rubber pad 34 at least partially extends into the filter element 32.

The shell 31 comprises a cylinder part 311, a bottom part 312 positioned at the bottom end of the cylinder part 311, a spring 313 arranged at the bottom part 312 and used for upwardly supporting the filter element 32, and a connecting block 314 positioned at the top end of the cylinder part 311. In an embodiment of the present invention shown in the drawings, the connecting block 314 is welded to the top end of the cylinder part 311. The connecting block 314 is provided with an internal thread. Correspondingly, the lower end part 332 is provided with an external thread matched with said internal thread. In order to enhance sealing and dust prevention, the filter 3 further comprises a sealing ring 315 sheathed onto the lower end part 332. Since the cylinder part 311 is relatively thin, it cannot be provided with a threaded structure; in the present invention, the connecting block 314 is provided to ingeniously solve the problem and reduce the costs. With reference to FIG. 10, the connecting block 314 is thicker than the wall of the cylinder part 311. In addition, in an embodiment of the present invention shown in the drawings, the bottom part 312 and the cylinder part 311 are separately arranged, and then are welded, so that the costs are lower. In an embodiment of the present invention, said shell is made from stainless steel, so as to be resistant to an alkaline solution.

In an embodiment of the present invention shown in the drawings, the filter 3 is a filter with an inflow from the outside and an outflow from the inside, and the flowing direction of said urea solution is shown in FIG. 10.

In the present invention, the shell 31 is in threaded connection with the head part 33; in this way, when it is necessary to replace the filter element 32, only the head part 33 and the shell 31 are required to be unscrewed, and the replacement of the whole filter 3 is not required, so that maintenance costs are reduced.

With reference to FIGS. 11-15, the fluid conveying device 4 comprises an integrated cabinet 41, a pump 42 mounted in the integrated cabinet 41, an inlet pipeline 43 positioned on one side of the pump 42, an outlet pipeline 44 positioned on the other side of the pump 42 and a controller 45 (see FIGS. 13 and 15) mounted in the integrated cabinet 41.

The integrated cabinet 41 is substantially rectangular parallelepiped, and comprises a front wall 411, a rear wall 412, a top wall 413, a bottom wall 414, a first sidewall 415 and a second sidewall 416. In an embodiment of the present invention shown in the drawings, the front wall 411 is a main operation interface, and a man-machine interaction interface 4111, an emergency stop switch 4112, a main power switch 4113, a monitoring indicator 4114 and a door lock 4115 are arranged on the front wall 411. The man-machine interaction interface 4111, the emergency stop switch 4112 and the main power switch 4113 are arranged in the middle of the front wall 411, and are sequentially arranged in the vertical direction from top to bottom. In this way, said main operation interface is generally consistent with a simple and symmetric aesthetic design. The man-machine interaction interface 4111, the emergency stop switch 4112 and the main power switch 4113 are positioned in the middle of the front wall 411 in the left-right direction, and follow a man-machine engineering principle in the top-down direction, so that an excellent comfort of the line of sight during operation is ensured. The emergency stop switch 4112 rapidly interrupts a power source of the system in an unexpected condition of the system, and follows a maximum principle to ensure the security of the system. The monitoring indicator 4114 can monitor and display the working state of the system in real time online. In an embodiment of the present invention shown in the drawings, the monitoring indicator 4114 is a tricolor lamp (for example, red, yellow and green). The tricolor lamp is a lamp, in which in different working states, the monitoring indicator 4114 displays light with different colors and frequencies. By means of said light display, the working state of the system can be clearly seen. Compared with the prior art adopting three lamps for displaying different colors respectively, the tricolor lamp in the present invention can reduce the costs and bring convenience to the layout. In an embodiment of the present invention shown in the drawings, the door lock 4115 is of a female/male triangular opening and closing structure, and endows the system with an excellent physical safety.

A number of harness connectors 4151 are mounted on the first sidewall 415, and the harness connectors 4151 are internally connected to the controller 45, the pump 42, various sensors and the like respectively, and are externally connected to an external signal of the system, a power supply and the like respectively. In an embodiment of the present invention shown in the drawings, the harness connectors 4151 are all close to the bottom of the integrated cabinet 41, which reduces the vibration intensity of the harness connectors 4151. The controller 45 is positioned on the inner side of the first sidewall 415.

Figure 15:
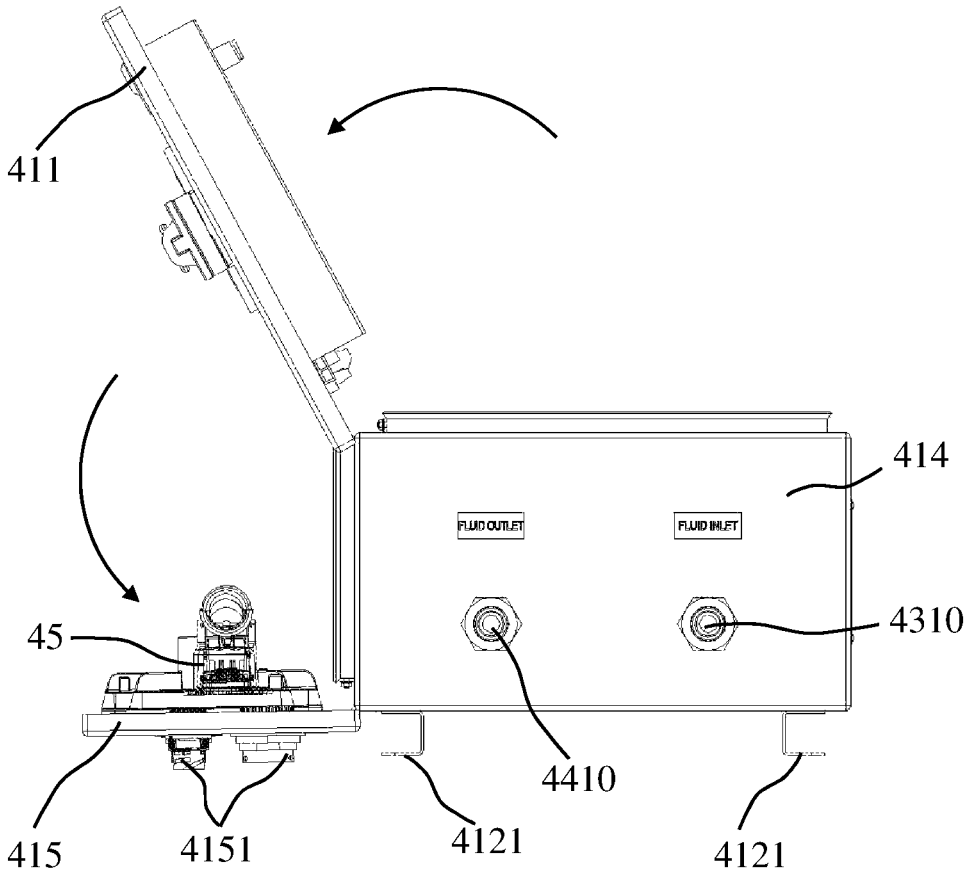
FIG. 15 is a bottom view of the fluid conveying device as claimed in the present invention, in which a front wall is opened by 120 degrees and a first sidewall is opened by 90 degrees.

With reference to FIG. 15, with reference to a closed position, the front wall 411 can be opened by 120 degrees, and the first sidewall 415 can be opened by 90 degrees. The front wall 411 and the first sidewall 415 have the same opening direction (for example, the counterclockwise direction in FIG. 15), so that convenience in the production and maintenance of the system is ensured.

It should be noted that the first sidewall 415 is connected to the integrated cabinet 41 via a fixing mechanism on its inner side, and by such a design, a door lock set can be saved, and the outside surface of the first sidewall 415 is simple and attractive in appearance. During use, if the first sidewall 415 needs to be opened, firstly it is necessary to open said front wall 411, and then the fixing mechanism is unlocked from the inner side, and finally the first sidewall 415 can be opened.

Figure 14:
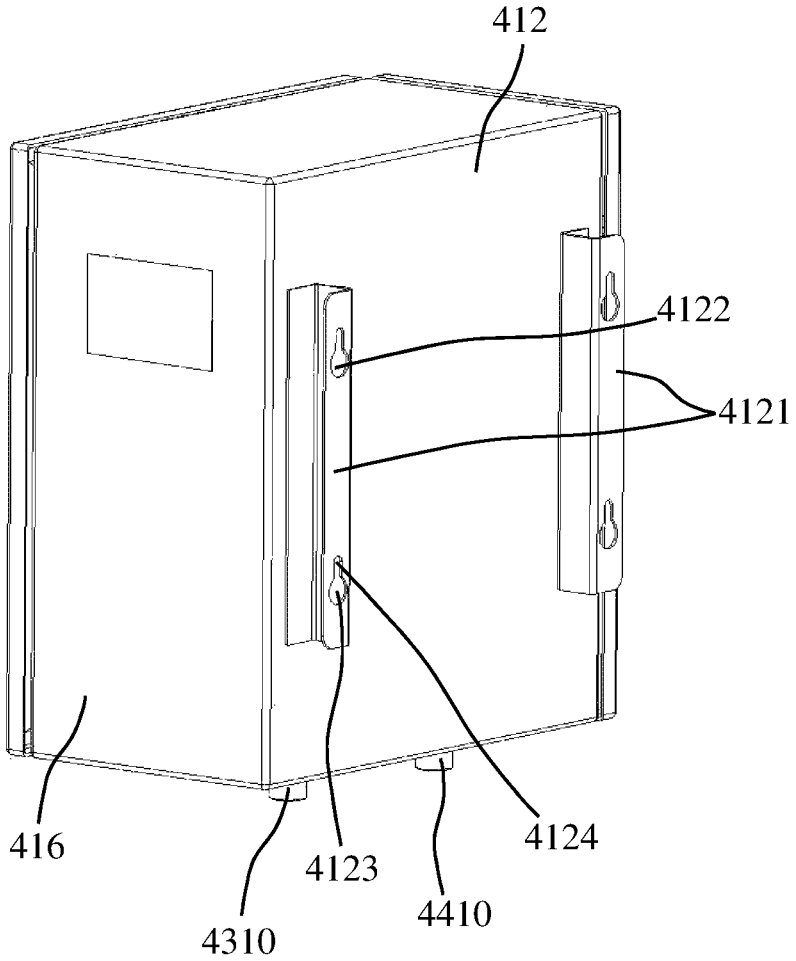
FIG. 14 is a perspective view from another angle of the fluid conveying device as claimed in the present invention.

With reference to FIG. 14, U-shaped supporting mechanisms 4121 are arranged on the rear wall 412, so that the integrated cabinet 41 can be mounted in a wall hanging manner. The supporting mechanisms 4121 are provided with mounting holes 4122, and each mounting hole 4122 comprises a guide part 4123 with a wider opening and a positioning part 4124 with a narrower opening, so that convenience and safety in assembly are ensured.

Figure 13:
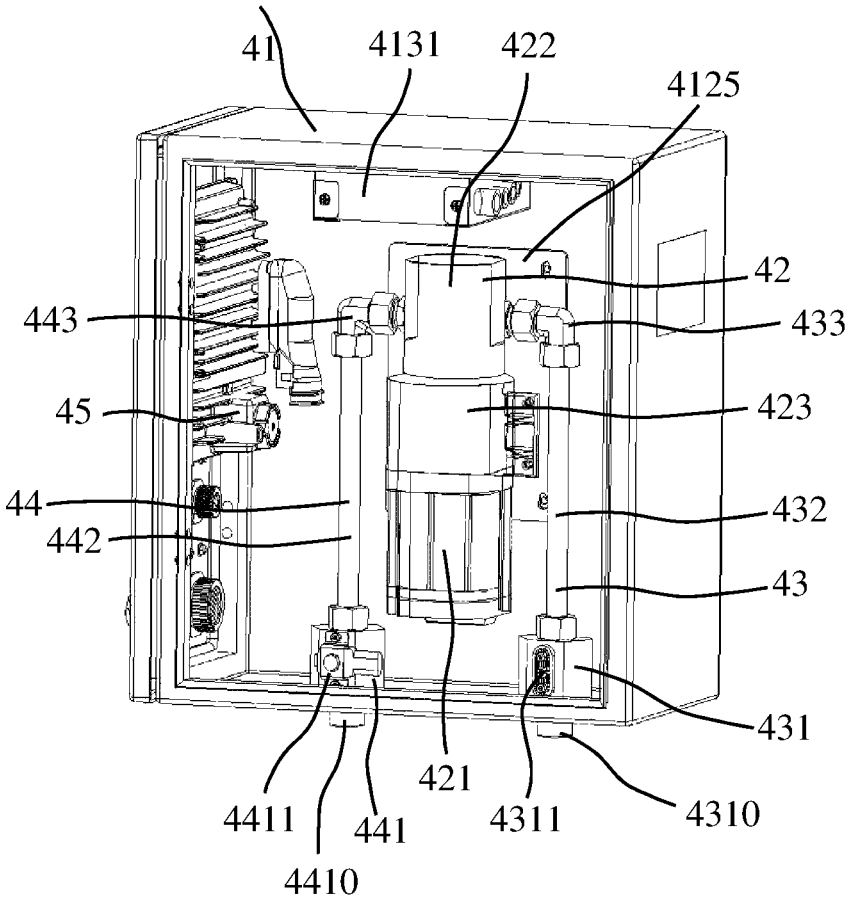
FIG. 13 is a schematic view of the fluid conveying device as claimed in the present invention, in which a front wall is removed.
Figure 16:
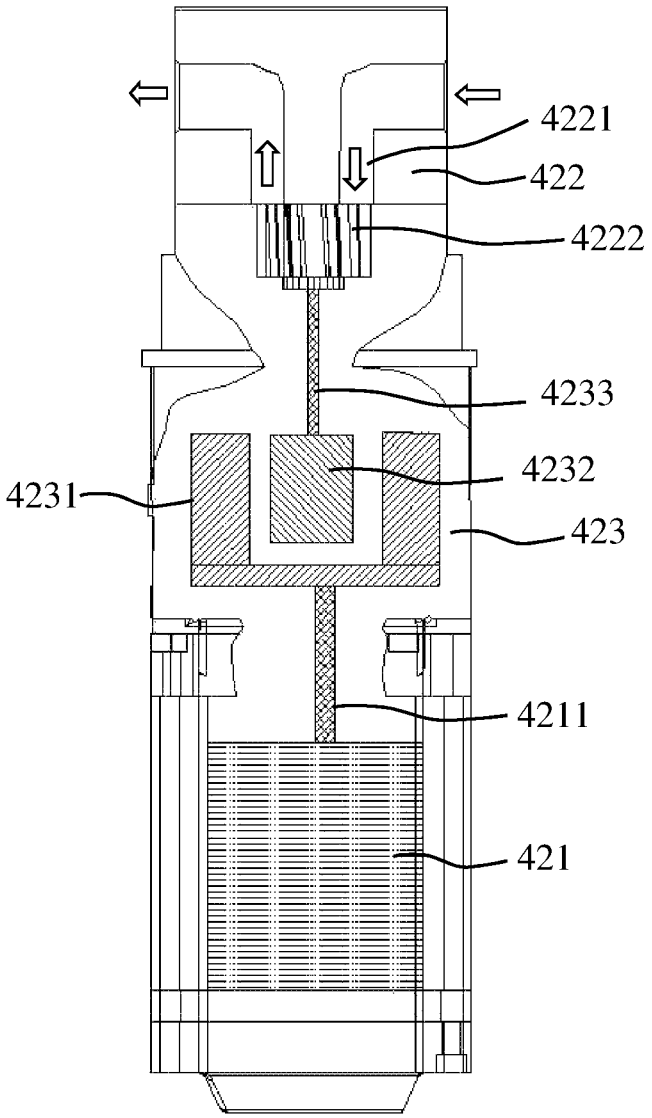
FIG. 16 is a sectional view of a motor in the fluid conveying device as claimed in the present invention.

With reference to FIG. 13, in an embodiment of the present invention shown in the figure, the pump 42 is a gear pump. The pump 42 comprises a motor 421 positioned at the bottom, a pump head 422 positioned at the top and a magnetic coupling part 423 positioned between the motor 421 and the pump head 422. With reference to FIG. 16, the motor 421 comprises a motor output shaft 4211. A U-shaped urea flow passage 4221 and a gear mechanism 4222 positioned at the bottommost of the urea flow passage 4221 are arranged in the pump head 422. The magnetic coupling part 423 comprises a driving magnetic driver 4231 and a driven magnetic driver 4232. The motor output shaft 4211 is fixedly connected to the driving magnetic driver 4231. The driven magnetic driver 4232 is provided with a pump head input shaft 4233, and the pump head input shaft 4233 is fixedly connected to the gear mechanism 4222.

During operation, the motor 421 is powered on, the motor output shaft 4211 drives the driving magnetic driver 4231 to rotate, then the driving magnetic driver 4231 drives the pump head input shaft 4233 to rotate, and the pump head input shaft 4233 further drives the gear mechanism 4222 to rotate, so that said urea solution can flow in the arrow of direction, and the outlet pressure of the urea solution is increased. In an embodiment of the present invention shown in the drawings, since the gear mechanism 4222 is positioned at the bottommost of the urea flow passage 4221, the accumulation of bubbles in the urea solution in the pump head 422 can be prevented, and the liquid pumping efficiency and delivery metering control accuracy are ensured.

The inlet pipeline 43 comprises a before-pumping monitoring module 431 positioned at the bottom end, an inlet pipe 432 connected to the before-pumping monitoring module 431 and an inlet connecting pipe 433 for connecting the inlet pipe 432 to the pump head 422. The inlet pipeline 43 being formed by connecting multiple parts can have the function of convenience in maintenance. In an embodiment of the present invention shown in the drawings, the before-pumping monitoring module 431 is of a hexahedral structure, and has the characteristics of high reliability, compactness and being lightweight. A negative pressure sensor 4311 and a urea temperature sensor are mounted on the before-pumping monitoring module 431, wherein whether the filter 3 needs to be replaced or not can be judged by monitoring the negative pressure sensor 4311.

Similarly, the outlet pipeline 44 comprises an after-pumping monitoring module 441 positioned at the bottom end, an outlet pipe 442 connected to the after-pumping monitoring module 441 and an outlet connecting pipe 443 which connects the outlet pipe 442 to the pump head 422. The outlet pipeline 44 being formed by connecting multiple parts can have the function of convenience in maintenance. In an embodiment of the present invention shown in the drawings, the after-pumping monitoring module 441 is of a hexahedral structure, and has the characteristics of high reliability, compactness and being lightweight. A pressure sensor 4411 is mounted on the after-pumping monitoring module 441, so as to detect the pressure of a high-pressure section.

In an embodiment of the present invention shown in the drawings, a perforation mounting method is adopted for each of the before-pumping monitoring module 431 and the after-pump monitoring module 441, that is to say, the before-pumping monitoring module 431 and the after-pump monitoring module 441 both penetrate through the bottom wall 414 of the integrated cabinet 41. A urea suction interface 4310 is formed in the before-pump monitoring module 431, a urea output interface 4410 is formed in the after-pump monitoring module 441, and the urea suction interface 4310 and the urea output interface 4410 are both positioned at the bottom of the integrated cabinet 41, so that the orientation and layout of external urea pipelines are fully protected, and mechanical collision and pollution caused by other liquid and dust are avoided. In addition, a parallel urea pipeline design is adopted for each of the before-pumping monitoring module 431 and the after-pumping monitoring module 441, so as to maximally reduce the pressure loss.

With reference to FIG. 13, in an embodiment of the present invention shown in the figure, the flow passage of said urea solution forms a coiled pipe for cooling liquid in the integrated cabinet 41. As a urea conveying power source, the pump 42 is arranged on an adjustment supporting mechanism 4125 of the rear wall 412 in the wall hanging manner, so that tolerance and adjustability during assembly in the vertical direction are ensured. In an embodiment of the present invention shown in the drawings, the pump 42 is arranged in the vertical direction, and the pump head 422 is vertically upward, so that on one hand, the alignment performance of the driving magnetic driver 4231 and the driven magnetic driver 4232 can be ensured on the basis of a magnetic driving mechanism, and the transmission efficiency of a magnetic driving force in a pump assembly can be improved; and on the other hand, the bubbles accumulated in the urea solution in the pump body can be eliminated, so as to ensure the liquid pumping efficiency and delivery metering control accuracy of the pump 42.

With reference to FIG. 13, a pump driving module 4131 mounted on the inner side of the top wall 413 is further arranged in the integrated cabinet 41. By means of such a design, the pump driving module 4131 can be mounted at a higher position, so as to prevent a short-circuit caused by the overflow of the urea solution. The pump driving module 4131 is closely attached to the top wall 413. In this way, heat produced during the working of the pump driving module 4131 can be promptly dissipated, and a normal working temperature of the pump driving module 4131 can be ensured. In addition, the pump driving module 4131 is close to the pump head 422, so that part of the heat radiated from the pump driving module 4131 could also be taken away by the urea solution in the pump head 422.

In addition, the above embodiments are only used to explain the present invention and not intended to limit the technical solution described in the present invention, and the understanding of this description should be based on a person skilled in the art, for example, "front-back penetration" refers to penetration before the mounting of other parts, and again for example, for the directional description such as "front", "rear", "left", "right", "upper" and "lower", although the present invention has been explained in the description in detail with reference to the above-mentioned embodiments, a person skilled in the art should understand that the present invention may have various modifications or equivalent replacements, and all the technical solutions and improvements thereof made without departing from the spirit and scope of the present invention shall fall within the scope of claims of the present invention.

The invention claimed is:

1. A fluid conveying device for conveying a urea solution in an engine exhaust gas treatment system, said fluid conveying device comprising an integrated cabinet, a pump vertically mounted in said integrated cabinet relative to the ground, an inlet pipeline connected to said pump and an outlet pipeline connected to said pump, said pump comprising a motor, a pump head positioned at the top further from the around than the motor and a magnetic coupling part positioned between said motor and said pump head, wherein said pump head, said magnetic coupling part and said motor are arranged from top to bottom relative to the ground, and a U-shaped flow passage and a gear mechanism are arranged in said pump head, the gear mechanism being positioned at a portion of said flow passage closer to the ground than other portions of said flow passage, wherein said inlet pipeline and said outlet pipeline are connected to two ends of the flow passage respectively, and said inlet pipeline, said outlet pipeline and said pump head are mutually connected to form an inverted U shape relative to the ground.

2. The fluid conveying device as claimed in claim 1, wherein said integrated cabinet is provided with a bottom wall, and said inlet pipeline is provided with a before-pumping pressure monitoring module close to said bottom wall, an inlet pipe connected to said before-pumping pressure monitoring module and vertically extending, and an inlet connecting pipe connected to said inlet pipe and said pump head; and said outlet pipeline is provided with an after-pumping pressure monitoring module close to said bottom wall, an outlet pipe connected to said after-pumping pressure monitoring module and vertically extending, and an outlet connecting pipe connected to said outlet pipe and said pump head.

3. The fluid conveying device as claimed in claim 2, wherein a negative pressure sensor and a urea temperature sensor are mounted on said before-pumping pressure monitoring module, and a pressure sensor is mounted on said after-pumping pressure monitoring module.

4. The fluid conveying device as claimed in claim 2, wherein each of said before-pumping pressure monitoring module and said after-pumping pressure monitoring module penetrates through said bottom wall, a urea suction interface is formed in said before-pumping pressure monitoring module, a urea output interface is formed in said after-pumping pressure monitoring module, and said urea suction interface and said urea output interface are both positioned at the bottom of said integrated cabinet.

5. The fluid conveying device as claimed in claim 1, wherein said integrated cabinet comprises a front wall, a rear wall, a top wall, a bottom wall, a first sidewall and a second sidewall, a man-machine interaction interface, an emergency stop switch, a main power switch, a monitoring indicator and a door lock are arranged on said front wall, and said man-machine interaction interface, said emergency stop switch and said main power switch are arranged in the middle of said front wall and are sequentially arranged in a vertical direction from top to bottom; a pump driving module mounted on the inner side of said top wall is further arranged in said integrated cabinet; and a number of harness connectors are exposed from the outer side of said first sidewall, and a controller is mounted on the inner side of said first sidewall.

6. The fluid conveying device as claimed in claim 5, wherein said pump driving module is attached to said top wall.

7. The fluid conveying device as claimed in claim 5, wherein said integrated cabinet is further provided with an adjustment supporting mechanism arranged on said rear wall, and said pump is arranged on said adjustment supporting mechanism in a wall hanging manner.

8. The fluid conveying device as claimed in claim 5, wherein said front wall is openable after said door lock is unlocked, a fixing mechanism connected to said integrated cabinet is arranged on the inner side of said first sidewall and is able to be unlocked after said front wall is opened, said first sidewall is openable after said fixing mechanism is unlocked, and an opening direction of said front wall is the same as that of said first sidewall.

9. The fluid conveying device as claimed in claim 1, wherein said magnetic coupling part comprises a driving magnetic driver and a driven magnetic driver, a pump head input shaft is arranged on said driven magnetic driver, and said pump head input shaft is connected to said gear mechanism.

* * * * *